US008578548B1

(12) United States Patent
Costello et al.

(10) Patent No.: US 8,578,548 B1
(45) Date of Patent: Nov. 12, 2013

(54) ABRASIVE CLEANING GLOVE

(76) Inventors: John Robert Costello, Valley Center, CA (US); Michael Christopher Costello, Portland, OR (US)

( * ) Notice: Subject to any disclaimer, the term of this patent is extended or adjusted under 35 U.S.C. 154(b) by 0 days.

(21) Appl. No.: 13/558,961

(22) Filed: Jul. 26, 2012

Related U.S. Application Data

(60) Provisional application No. 61/514,571, filed on Aug. 3, 2011.

(51) Int. Cl.
*A47L 13/18* (2006.01)

(52) U.S. Cl.
USPC ..... 15/227

(58) Field of Classification Search
USPC ..... 15/227
See application file for complete search history.

(56) References Cited

U.S. PATENT DOCUMENTS

| | | | | |
|---|---|---|---|---|
| 1,569,854 | A * | 1/1926 | Doerr | 15/227 |
| 1,766,365 | A | 6/1930 | Weiss et al. | |
| 2,269,871 | A | 1/1942 | de Botelho | |
| 3,643,386 | A | 2/1972 | Grzyll et al. | |
| 3,711,889 | A | 1/1973 | Jennings | |
| 4,038,787 | A | 8/1977 | Biannchi | |
| 4,065,826 | A | 1/1978 | Hough | |
| 4,155,870 | A | 5/1979 | Jorgensen | |
| 4,168,545 | A | 9/1979 | Kupperman et al. | |
| 4,371,988 | A | 2/1983 | Berend | |
| 4,670,930 | A | 6/1987 | Lu | |
| 4,696,593 | A | 9/1987 | Bayless | |
| 4,893,955 | A | 1/1990 | Zielinski | |
| 4,980,943 | A | 1/1991 | Barber | |
| 5,003,638 | A | 4/1991 | Miyake et al. | |
| 5,134,746 | A | 8/1992 | William | |
| 5,439,487 | A * | 8/1995 | Stanitzok | 15/227 |
| 5,564,154 | A | 10/1996 | Cohn | |
| 5,800,446 | A | 9/1998 | Banuchi | |
| 5,924,160 | A | 7/1999 | Bradley | |
| 5,979,007 | A | 11/1999 | Soon | |
| 6,026,534 | A | 2/2000 | Gonda et al. | |
| 6,290,707 | B1 | 9/2001 | Street | |
| 6,292,948 | B1 | 9/2001 | Chen | |
| 6,481,766 | B1 | 11/2002 | May | |
| 6,513,998 | B1 | 2/2003 | Barry | |
| 6,968,808 | B2 | 11/2005 | Claire | |
| 7,584,519 | B2 | 9/2009 | Ouellette et al. | |
| 7,725,979 | B1 | 6/2010 | Held et al. | |
| 7,823,245 | B2 | 11/2010 | Firouzman | |
| 8,152,929 | B1 | 4/2012 | Perring | |
| 2003/0014824 | A1 | 1/2003 | Farmer | |
| 2003/0143368 | A1 | 7/2003 | Kohlruss et al. | |
| 2005/0177965 | A1 | 8/2005 | Edoh | |
| 2005/0193515 | A1 * | 9/2005 | Chang | 15/227 |
| 2006/0211352 | A1 | 9/2006 | Adams | |
| 2007/0039116 | A1 | 2/2007 | Woodard | |

(Continued)

FOREIGN PATENT DOCUMENTS

JP 2002-309538 * 10/2002

*Primary Examiner* — Randall Chin
(74) *Attorney, Agent, or Firm* — Plager Schack LLP

(57) ABSTRACT

An abrasive cleaning glove comprises a cleaning glove. The cleaning glove comprising a hand portion mechanically coupled to a cuff. The hand portion is made of a material. The material comprises a plurality of warp threads around a series of waft threads. The plurality of warp threads and the series of waft threads are in a pattern that reveals several surface heights caused by various needle pitches to enhance cleaning.

3 Claims, 2 Drawing Sheets

(56) References Cited

U.S. PATENT DOCUMENTS

| | | | | |
|---|---|---|---|---|
| 2007/0086828 | A1 | 4/2007 | Stewart | |
| 2007/0118963 | A1 | 5/2007 | Snyder | |
| 2008/0178366 | A1 | 7/2008 | Daher | |
| 2008/0295219 | A1 * | 12/2008 | Andersen et al. | 2/161.6 |
| 2008/0301852 | A1 | 12/2008 | Suran et al. | |
| 2010/0218326 | A1 | 9/2010 | Yamaguchi | |
| 2010/0287720 | A1 | 11/2010 | Kayata, Sr. et al. | |
| 2011/0004974 | A1 | 1/2011 | Firouzman | |
| 2011/0005017 | A1 | 1/2011 | Merriweather | |
| 2011/0029004 | A1 | 2/2011 | Papetti | |
| 2011/0056036 | A1 | 3/2011 | Kuester | |
| 2011/0088190 | A1 | 4/2011 | Clark | |
| 2011/0167581 | A1 * | 7/2011 | Arzarzar | 15/227 |
| 2011/0258755 | A1 | 10/2011 | Arfi | |

* cited by examiner

ABRASIVE CLEANING GLOVE

CROSS REFERENCE TO RELATED APPLICATIONS

This application claims priority to U.S. Provisional Patent Application 61/514,571 filed on Aug. 3, 2011.

FIELD OF THE INVENTION

This invention relates to devices designed to be worn upon and clean a user's hand.

BACKGROUND OF THE INVENTION

Paints, grease, grime, oil, caulks, glues, inks and stains are difficult to remove from a user's skin as well as a variety of surfaces. The present invention easily cleans the problems listed through abrasive cleaning. The prior art has some difficulties with this problem.

U.S. Patent application 2008/0295219 by Anderson teaches a glove for peeling a potato. Anderson's glove is heat treated for hardness, which teaches away from the present invention that utilizes a textured surface to clean a hand. Further, Anderson mistakenly relies upon a hardened polymer, which is ineffective when compared to the disclosed invention's nylon/elastic thread.

U.S. Patent application 2011/0167581 by Arzarar teaches a glove with a textured surface for cleaning, the glove comprises a thermoplastically bonded together an inner layer and an outer layer of polyurethane. Again, the reliance on polyurethane manufactured in this manner creates a different and ineffective texture when compared to the disclosed invention.

U.S. Patent application 2003/0143368 by Kohlruss is likewise polymer based where it forms a series of brush like barbs to clean skin. This was written as a chemical patent and was rejected, among other reasons because drawings failed to show the texture. Kohlruss emphasizes uniform brush fibers as opposed to various needle pitches used in the disclosed invention.

BRIEF SUMMARY OF THE INVENTION

An abrasive cleaning glove comprises a cleaning glove. The cleaning glove comprising a hand portion mechanically coupled to a cuff. The hand portion is made of a material. The material comprises a plurality of warp threads around a series of waft threads. The plurality of warp threads and the series of waft threads are in a pattern that reveals several surface heights caused by various needle pitches to enhance cleaning.

BRIEF DESCRIPTION OF THE SEVERAL VIEWS OF THE DRAWINGS

Figure 1:
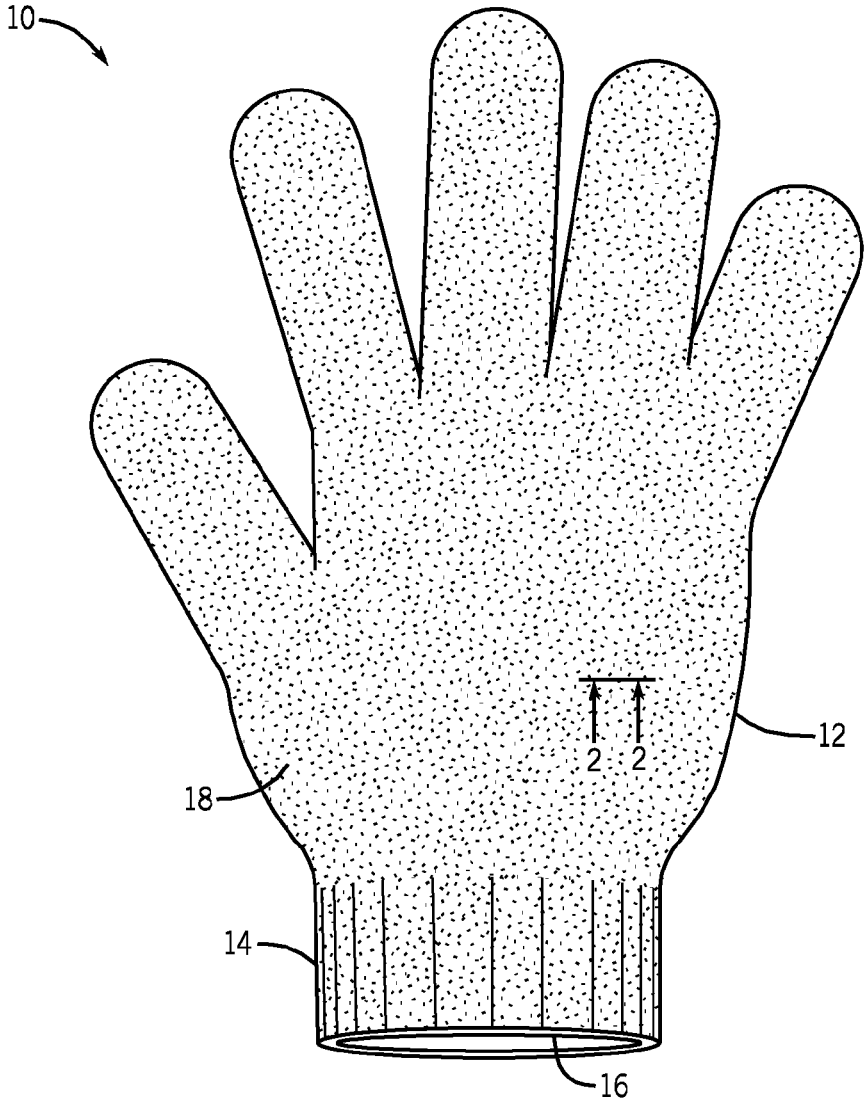

Having thus described the invention in general terms, reference will now be made to the accompanying drawings, which are not necessarily drawn to scale, and wherein:

FIG. 1 is a perspective view of the invention.

Figure 2:
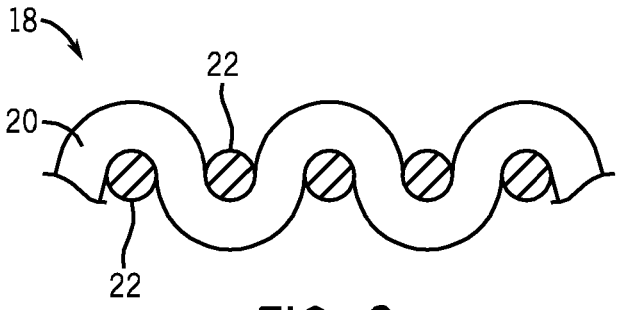

FIG. 2 is a greatly enlarged cross-sectional view taken on line 2-2 of FIG. 1.

Figure 3:
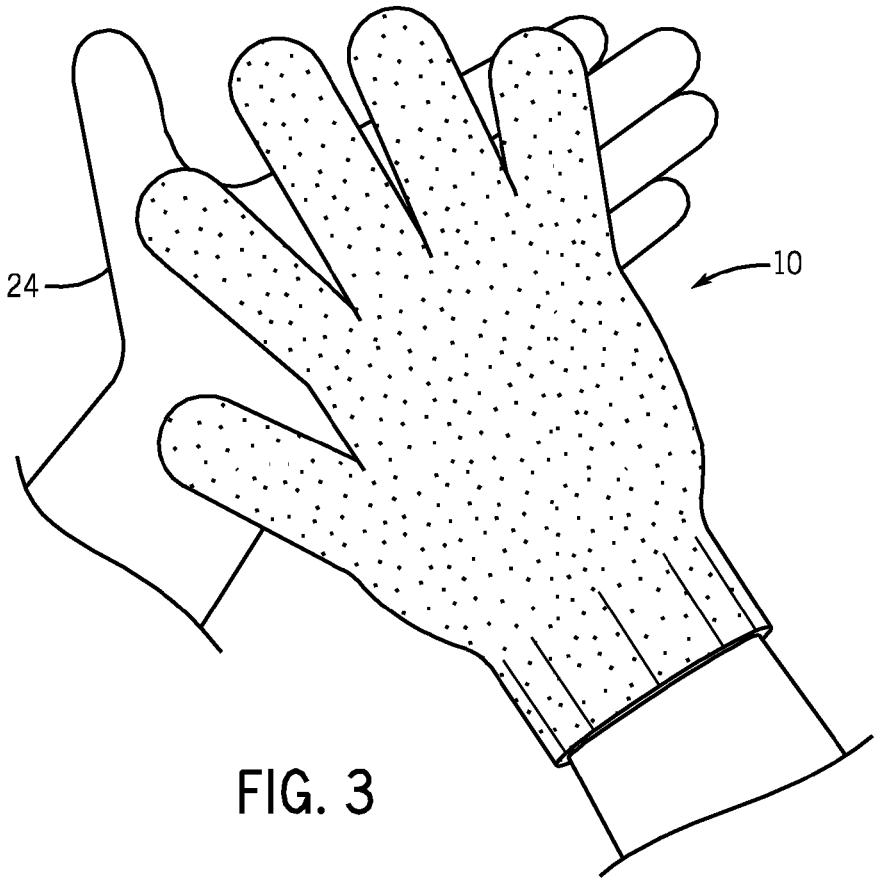

FIG. 3 is a perspective view showing the invention in use.

DETAILED DESCRIPTION OF THE INVENTION

Embodiments of the present invention overcome many of the obstacles associated with washing hands or other surfaces with a glove, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows a perspective view of the invention. Cleaning glove 10 comprises hand portion 12 mechanically coupled to cuff 14. Cuff 14 further comprises hand opening 16 through which a user can insert hand 24 as shown in FIG. 3. Cleaning glove 14 is made of material 18 as shown in more detail in FIG. 2.

FIG. 2 shows a magnified section view of material 18. Cleaning glove 10 can be made through a series of steps called a "method of manufacture" that includes the following steps, which are not necessarily in order.

Cleaning glove 10 can be manufactured using the principle of the sinker knitting system on a glove knitting machine creating a plurality of warp threads 20 around a series of waft threads 22. The method of manufacture of cleaning glove 10 uses mosaic type needle bars and sedimentary slice principles of a glove knitting machine to allow elasticity. The method of manufacture of cleaning glove 10 further involves air jet propelled devices on a glove knitting machine to give cleaning glove 10 more elasticity. The method of manufacture includes inlaid neilsbed and sedimentation piece devices on a glove knitting machine to allow the glove stretch and conformation of the hand. In the preferred embodiment cleaning glove 10 comprises 100% nylon and combinations of elastic and nylon, which may vary in proportion. The manufacture of cleaning glove 10 involves a rib-stitched wrist area to form cuff 14 and hand opening 16 with at least one elastic thread to allow the glove cuff to conform to different wrist sizes. The glove is knitted or twilled of a least 2 threads of material such as nylon and elastic.

Cleaning glove 10 should be knitted to provide a textured surface that allows cleaning of skin and other surfaces. Cleaning glove 10 is knitted in a pattern that reveals several surface heights to enhance cleaning. One way to have the varying surface heights is to vary the needle pitches. The needle pitches may vary from 7G 8G 10G 13G with a needle size from 93-103. Additionally, using a double jet propelled device on the knitting machine to allow the fabric to show more grade.

The unique thickness of the thread, the size of the stitches, and type of thread, all contribute to provide sufficient integrity, mechanical and chemical resistance to avoid decomposition of the device in the cleaning process. In this manner, Anderson, Arzarar and Kohlruss are misguided by having uniform lengths of stitching in plastic material.

In the preferred embodiment, the thread is pre-dyed before manufacturing to allow for all components to be colored before manufacturing. The manufacture of cleaning glove 10 allows for cleaning glove 10 to be used on a user's left or right hand. The stitching pattern for the knitting machine is configured into the shape and size, but not limited to, that of the adult hand with four fingers and one thumb. Of course, assorted sizes can be used.

FIG. 3 shows cleaning glove 10 in use. To use cleaning glove 10 a user inserts first hand 24 into cleaning glove 10 and then rubs cleaning glove 10 over second hand 24. The peaks of various heights and other features enable the user to rapidly clean hands without the use of chemicals.

That which is claimed:

1. An abrasive cleaning glove, comprising, a cleaning glove, further comprising a hand portion mechanically coupled to a cuff; where the hand portion is made of a material;

the material comprises a plurality of warp threads around a series of waft threads;

the plurality of warp threads and the series of waft threads in a pattern that reveals several surface heights and are spaced with various needle pitches of at least two of 7G 8G 10G and 13G to enhance cleaning.

2. The abrasive cleaning glove of claim 1, the plurality of warp threads and the series of waft threads are formed by mosaic type needle bars and sedimentary slice principles of a glove knitting machine to allow elasticity; air jet propelled devices on the glove knitting machine allow further elasticity; inlaid neilsbed and sedimentation piece devices on the glove knitting machine allow the cleaning glove to conform with a user's hand.

3. The abrasive cleaning glove of claim 1, a rib-stitched wrist area to form the cuff and a hand opening with at least one elastic thread to allow the cuff to conform to different wrist sizes.

* * * * *